US008052247B2

(12) United States Patent
Ouchi

(10) Patent No.: US 8,052,247 B2
(45) Date of Patent: Nov. 8, 2011

(54) IMAGE FORMING APPARATUS

(75) Inventor: Kengo Ouchi, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 340 days.

(21) Appl. No.: 12/396,179

(22) Filed: Mar. 2, 2009

(65) Prior Publication Data

US 2009/0231390 A1 Sep. 17, 2009

(30) Foreign Application Priority Data

Mar. 17, 2008 (JP) ..... 2008-067055

(51) Int. Cl.
*B41J 2/15* (2006.01)

(52) U.S. Cl. ..... 347/40

(58) Field of Classification Search ..... 347/20, 347/40–42, 84, 85
See application file for complete search history.

(56) References Cited

U.S. PATENT DOCUMENTS

| | | | | |
|---|---|---|---|---|
| 6,520,632 | B1 | 2/2003 | Yamazaki et al. | |
| 6,755,513 | B1 * | 6/2004 | Silverbrook et al. | 347/85 |

FOREIGN PATENT DOCUMENTS

| | | |
|---|---|---|
| JP | 42-1256 | 1/1967 |
| JP | 60-10956 | 1/1985 |
| JP | 5-40688 | 6/1993 |
| JP | 10-58700 | 3/1998 |
| JP | 2001-63759 | 3/2001 |
| JP | 2001-171142 | 6/2001 |
| JP | 2003-39672 | 2/2003 |
| JP | 2005-74923 | 3/2005 |
| JP | 2005-144709 | 6/2005 |
| JP | 2005-169695 | 6/2005 |
| JP | 2006-231770 | 9/2006 |

OTHER PUBLICATIONS

May 15, 2009 Japanese official action in connection with a related Japanese patent application.

Aug. 18, 2009 Japanese official action in connection with related Japanese patent application.

* cited by examiner

*Primary Examiner* — An Do
(74) *Attorney, Agent, or Firm* — Cooper & Dunham LLP

(57) ABSTRACT

An image forming apparatus includes a plurality of heads each of which discharges liquid droplets, a base member to hold the heads arranged thereon, and a liquid supply member provided on each head to extend in a direction in which the heads are arranged, and to form a common channel for distributing and supplying liquid to the heads. The liquid supply member includes a first supply opening to receive ink in the liquid supply member, a second supply opening to supply ink to the head, and an annular seal member and provided between the liquid supply member and the head to connect the first and second supply openings by sealing a connection portion between the liquid supply member and the head.

5 Claims, 8 Drawing Sheets

IMAGE FORMING APPARATUS

TECHNICAL FIELD

This disclosure relates to an image forming apparatus, and more particularly, to an image forming apparatus including a recording head that discharges liquid droplets.

BACKGROUND ART

Image forming apparatuses include, for example, a printer, a facsimile machine, a copier, a plotter, and a multifunctional machine combining several of the functions of these apparatuses. As an image forming apparatus using a liquid discharge recording method that uses a recording head that discharges ink liquid droplets, for example, an inkjet recording apparatus is known.

Image forming apparatuses using the liquid discharge recording method perform image formation (hereinafter used as a synonym for recording, imaging, and printing) by discharging the ink droplets from the recording head onto a sheet being conveyed. Herein, such sheet is not limited to paper but includes any material to which the ink droplets and other liquids can adhere, such as an OHP (overhead projector) sheet, and is referred to also as a recorded medium, a recording medium, recording paper, a recording sheet, and so forth.

Image forming apparatuses using the liquid discharge recording method can be divided into serial-type image forming apparatuses which form an image by discharging liquid droplets from a recording head that moves in a main scanning direction, and line-type image forming apparatuses which form an image by using a line-type recording head that discharges liquid droplets while the head remains stationary.

As an example of the image forming apparatus as described above, a line-type image forming apparatus is known, as described above, which includes a line-type recording head including nozzle arrays arranged to cover the full width of the sheet being conveyed. The line-type recording head used in this case includes, for example, a plurality of short heads that themselves include arrays of nozzles for discharging liquid droplets, and which are arranged in the nozzle arrangement direction. This type of recording head is referred to as a multiple array head.

In the multiple array head as described above, ink is supplied to the plurality of heads. Further, ink is supplied to respective heads of the multiple array head from an ink tank generally through a flexible supply tube.

Since ink is supplied to the multiple array head through the flexible supply tube as described above, an equal number of the supply tubes is necessary, resulting in a complex tube system. Accordingly, it is not easy to assemble and maintain the tube system because of such complex tube arrangement.

Further, the supply tube must be released when changing the head, risking scattering ink and allowing air to get into an ink supply path. Further, ink may leak from a connecting portion between the supply tubes, and so-called slow-air-leak may occur, in which air leaks out gradually.

BRIEF SUMMARY

In an aspect of this disclosure, an image forming apparatus includes a plurality of heads each of which discharges liquid droplets, a base member to hold the heads being arranged thereon, and a liquid supply member provided on the head to extend in a direction in which the heads are arranged, and to form a common channel for distributing and supplying liquid to the heads. The liquid supply member includes a first supply opening to receive ink in the liquid supply member, a second supply opening to supply ink to the head, and an annular seal member and provided between the liquid supply member and the head to connect the first and second supply openings by sealing a connection portion between the liquid supply member and the head.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
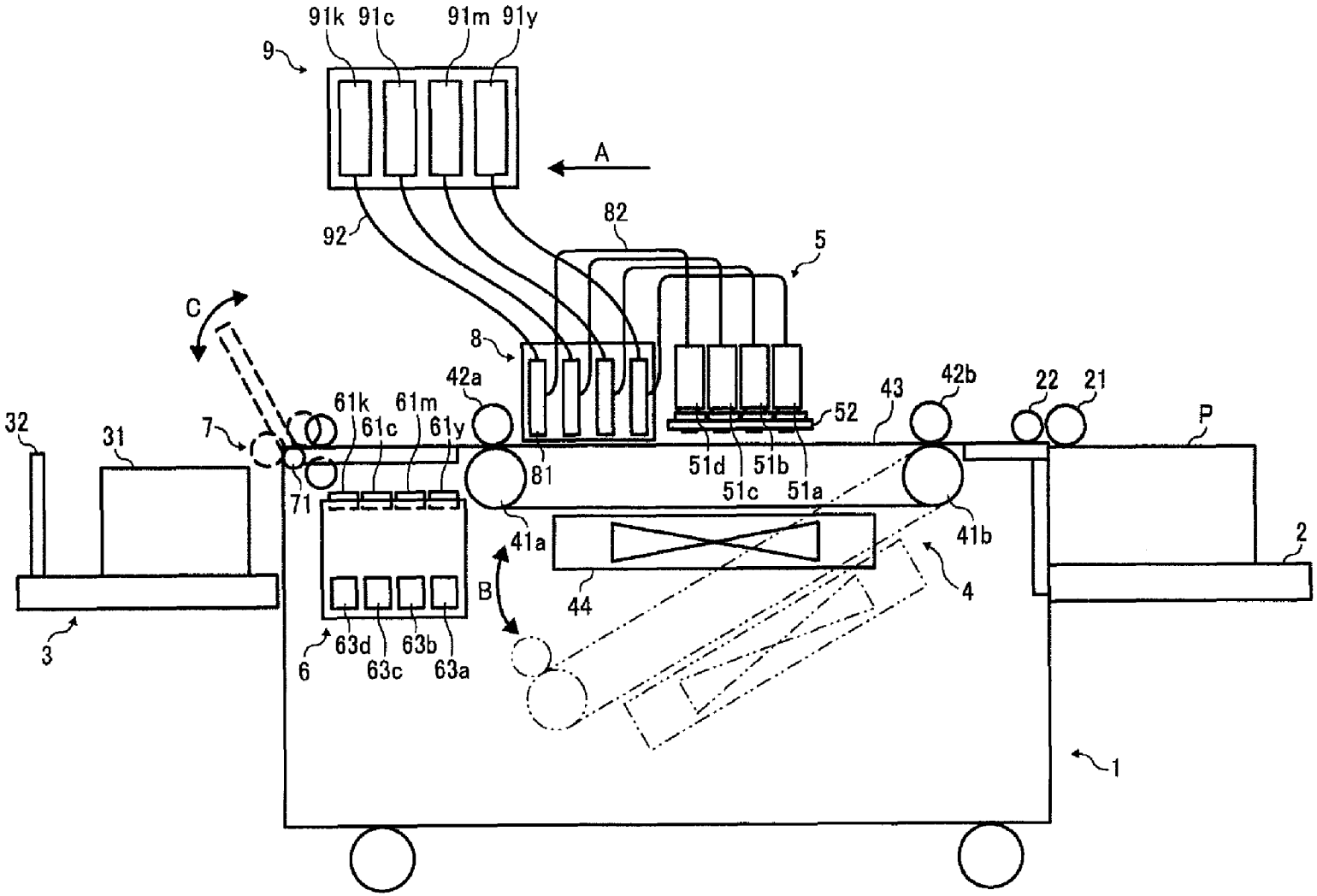
FIG. 1 is a schematic explanatory side view illustrating the overall configuration of an example of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, particularly to FIGS. 1 and 2, an example of an image forming apparatus according to an illustrative embodiment of the present invention will be described.

Figure 2:
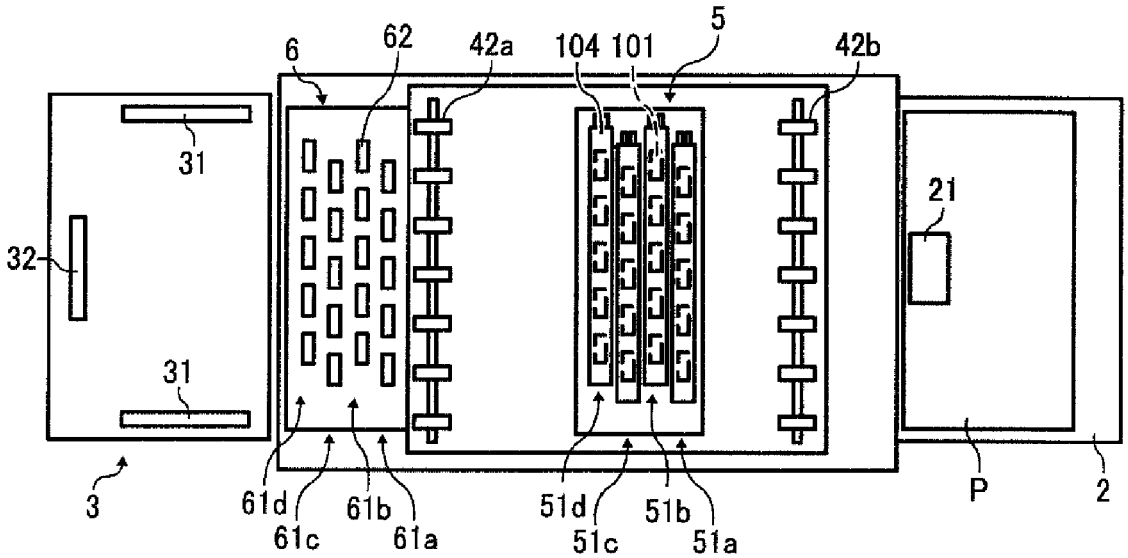
FIG. 2 is a schematic explanatory plan view of the image forming apparatus of FIG. 1.

FIG. 1 is a schematic configuration view illustrating the overall configuration of the image forming apparatus. FIG. 2 is a schematic explanatory plan view of the image forming apparatus.

The image forming apparatus is a line-type image forming apparatus including an apparatus body 1, a sheet feeding tray 2, a sheet discharging tray 3, a conveying unit 4, an image forming unit 5, a cleaning unit 6, a conveying and guiding unit 7, an ink tank unit 8, and a main tank unit 9.

The sheet feeding tray 2 holds a stack of sheets P to be fed. The sheet discharging tray 3 holds the printed sheets P discharged and stacked thereon. The conveying unit 4 conveys each of the sheets P from the sheet feeding tray 2 to the sheet discharging tray 3. The image forming unit 5 includes head modules 51*a*, 51*b*, 51*c*, and 51*d* according to an embodiment of the present invention, which discharge liquid droplets onto the sheet P conveyed by the conveying unit 4 to perform a printing operation. The cleaning unit 6 serves as a maintenance and restoration mechanism for performing the maintenance and restoration of respective recording heads of the image forming unit 5 after the completion of the printing operation or at required timing. The conveying and guiding unit 7 opens and closes the cleaning unit 6. The ink tank unit 8 supplies ink to the head modules 51*a*, 51*b*, 51*c*, and 51*d* of the image forming unit 5. The main tank unit 9 supplies ink to the ink tank unit 8.

The apparatus body 1 is formed by not-illustrated front, rear, and side plates and stays. The sheets P stacked on the sheet feeding tray 2 are fed one by one to the conveying unit 4 by a separation roller 21 and a sheet feeding roller 22.

The conveying unit 4 includes a conveyance drive roller 41*a*, a conveyance driven roller 41*b*, and a circular conveying belt 43 stretched therebetween. A surface of the conveying belt 43 is formed with a plurality of not-illustrated holes. Under the conveying belt 43, a suction fan 44 is provided to suction the sheet P. Above the conveyance drive roller 41*a* and the conveyance driven roller 41*b*, conveyance guiding rollers 42*a* and 42*b* respectively held by not-illustrated guide members are brought into contact with the conveying belt 43 by the weight thereof.

The conveying belt 43 is rotationally moved along with the rotation of the conveyance drive roller 41*a* caused by a not-illustrated motor. The sheet P is suctioned onto the conveying belt 43 by the suction fan 44 and conveyed along with the rotational movement of the conveying belt 43. The conveyance driven roller 41*b* and the conveyance guiding rollers 42*a* and 42*b* are driven to rotate by the conveying belt 43.

Above the conveying unit 4, the image forming unit 5, which includes the plurality of head modules 51*a*, 51*b*, 51*c*, and 51*d* for discharging the liquid droplets onto the sheet P for the printing operation, is provided to be movable in a direction indicated by an arrow A in FIG. 1 and in a direction opposite thereto. In the maintenance and restoration operation (i.e., a cleaning operation), the image forming unit 5 is moved to a position above the cleaning unit 6. Meanwhile, in the image forming operation, the image forming unit 5 is moved back to the position illustrated in FIG. 1.

In the image forming unit 5, the head modules 51*a*, 51*b*, 51*c*, and 51*d* are arranged on a line head base member 52 in a sheet conveyance direction. In each of the head modules 51*a*, 51*b*, 51*c*, and 51*d*, a plurality of heads are arranged in an array. Each of the plurality of heads includes two nozzle arrays, in each of which a plurality of nozzles for discharging the liquid droplets are provided. In the present embodiment, the liquid droplets of the Y (yellow) color are discharged from one of two nozzle arrays of each of the head modules 51*a* and 51*b*, and the liquid droplets of the M (magenta) color are discharged from the other one of the two nozzle arrays. Further, the liquid droplets of the C (cyan) color are discharged from one of two nozzle arrays of each of the head modules 51*c* and 51*d*, and the liquid droplets of the K (black) color are discharged from the other one of the two nozzle arrays.

That is, the image forming unit 5 is configured such that each two of the head modules 51*a*, 51*b*, 51*c*, and 51*d* for discharging the liquid droplets of the same color are arranged side by side in the sheet conveyance direction to form one nozzle array extending the width of the sheet P.

Upstream of the image forming unit 5, the ink tank unit 8 is provided which includes ink tanks 81 (for ease of illustration, the reference numeral 81 is given only for one ink tank). The ink in the ink tanks 81 is supplied to the respective head modules 51*a*, 51*b*, 51*c*, and 51*d* through respective supply tubes 82. Due to the water head difference between the ink tanks 81 and the head modules 51*a*, 51*b*, 51*c*, and 51*d*, negative pressure on the respective heads of the head modules 51*a*, 51*b*, 51*c*, and 51*d* is generated.

The ink tank unit 8 is provided to be movable in the direction indicated by the arrow A together with the image forming unit 5. For convenience of illustration, the supply tubes 82 extending from the ink tanks 81 to the head modules 51*a*, 51*b*, 51*c*, and 51*d* are illustrated in FIG. 1 as if the supply tubes 82 are connected to respective upper portions of the head modules 51*a*, 51*b*, 51*c*, and 51*d*. As described later, however, the supply tubes 82 are connected to respective end portions of the head modules 51*a*, 51*b*, 51*c*, and 51*d* in a longitudinal direction thereof, i.e., a direction perpendicular to the sheet conveyance direction.

Upstream of the ink tanks 81, the main tank unit 9 is provided which supplies the ink from main tanks 91*y*, 91*m*, 91*c*, and 91*k* thereof to the ink tanks 81 through respective supply tubes 92.

Downstream of the conveying unit 4, the conveying and guiding unit 7 is provided which discharges the sheet P onto the sheet discharging tray 3. The conveying and guiding unit 7 includes a fulcrum 71 later described. The sheet P guided and conveyed by the conveying and guiding unit 7 is discharged onto the sheet discharging tray 3. The sheet discharging tray 3 includes a pair of side fences 31 for aligning the sheet P in the width direction and an end fence 32 for aligning the leading end of the sheet P.

The cleaning unit (i.e., the maintenance and restoration mechanism) 6 includes four cleaning devices 61*y*, 61*m*, 61*c*, and 61*k* corresponding to the respective head modules 51*a*, 51*b*, 51*c*, and 51*d* of the image forming unit 5. Each of the cleaning devices 61*y*, 61*m*, 61*c*, and 61*k* includes not-illustrated wiping members and cap members 62 (see FIG. 2) corresponding to the respective heads of the corresponding one of the head modules 51*a*, 51*b*, 51*c*, and 51*d*. The cap members 62 of the respective cleaning devices 61*y*, 61*m*, 61*c*, and 61*k* are configured to be vertically movable for each array. Under the cleaning devices 61*y*, 61*m*, 61*c*, and 61*k*, suction pumps 63*a*, 63*b*, 63*c*, and 63*d* are provided which suction the ink from the nozzles, with nozzle surfaces of the head modules 51*a*, 51*b*, 51*c*, and 51*d* capped with the respective cap members 62.

After the printing operation in the image forming apparatus, the cleaning devices 61*y*, 61*m*, 61*c*, and 61*k* suction the ink from the nozzles while capping the nozzle surfaces of the respective heads of the head modules 51*a*, 51*b*, 51*c*, and 51*d* for discharging the liquid droplets, or remove the ink adhering to the nozzle surfaces of the respective heads of the head modules 51*a*, 51*b*, 51*c*, and 51*d* by using the wiping members. In this case, as illustrated in FIG. 1, the entire conveying unit 4 is rotated downward in one of the directions indicated by double-headed arrow B after the completion of the printing operation, with the conveyance driven roller 41*b* acting as a fulcrum, thereby enlarging the space between the conveying unit 4 and the image forming unit 5 so that it becomes larger than in the image forming operation, and space for the movement of the image forming unit 5 is secured. At the same time, the conveying and guiding unit 7 located above the cleaning unit 6 is rotated upward around the fulcrum 71 in one of the directions indicated by double-headed arrow C, and an upper part of the cleaning unit 6 is opened.

After the conveying unit 4 and the conveying and guiding unit 7 have been opened (i.e., released), the image forming unit 5 is moved in the sheet feeding direction (i.e., the direction indicated by the arrow A) and stopped at a position above the cleaning unit 6. Then, the cleaning unit 6 is elevated to perform the cleaning operation (i.e., the maintenance and restoration operation) on the respective head modules 51*a*, 51*b*, 51*c*, and 51*d*.

Subsequently, with reference to FIGS. 3 to 9, a detailed description is given of the head modules 51*a*, 51*b*, 51*c*, and 51*d*.

Figure 3:
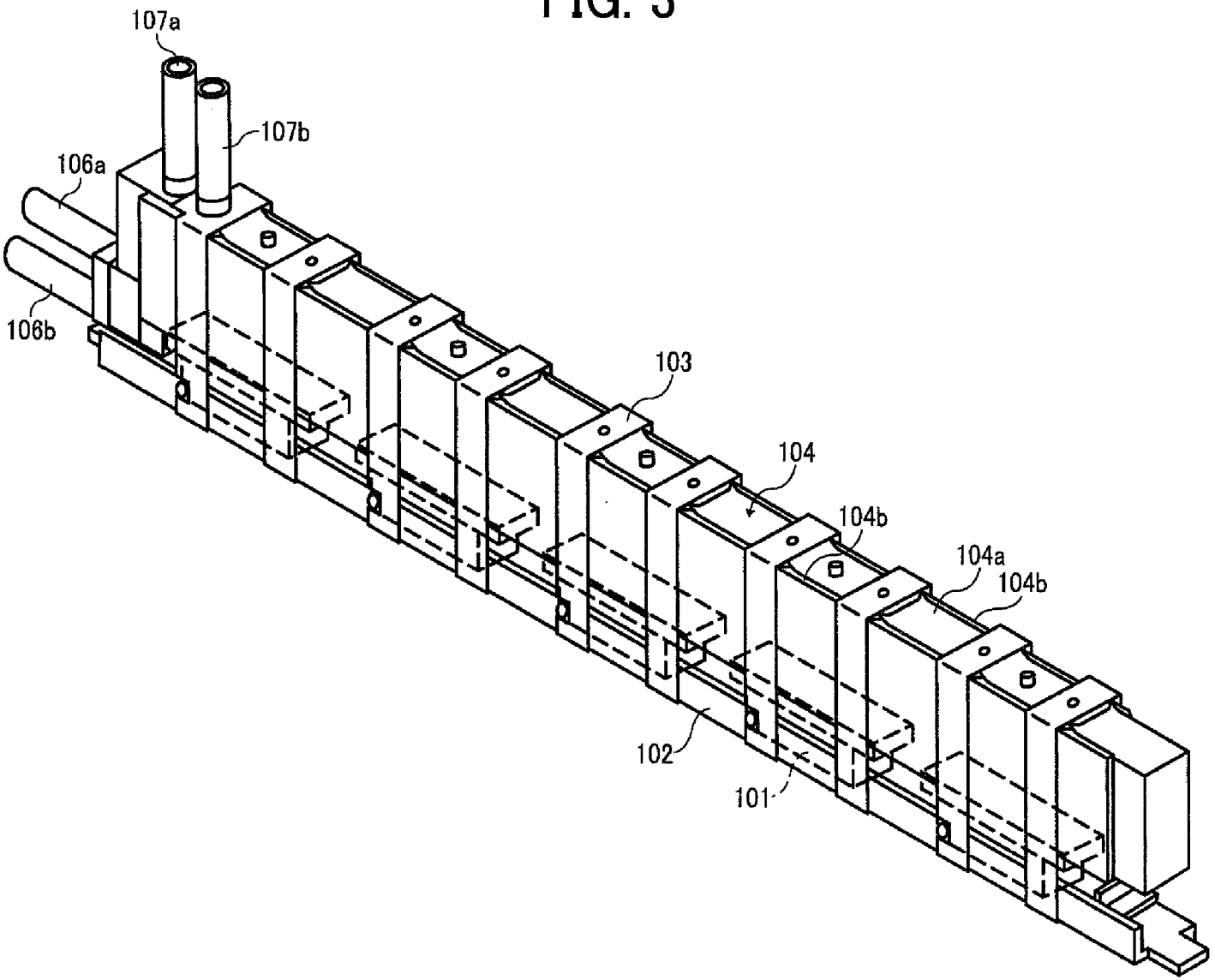
FIG. 3 is an explanatory perspective view of a head module used in the image forming apparatus of FIG. 1.
Figure 4:
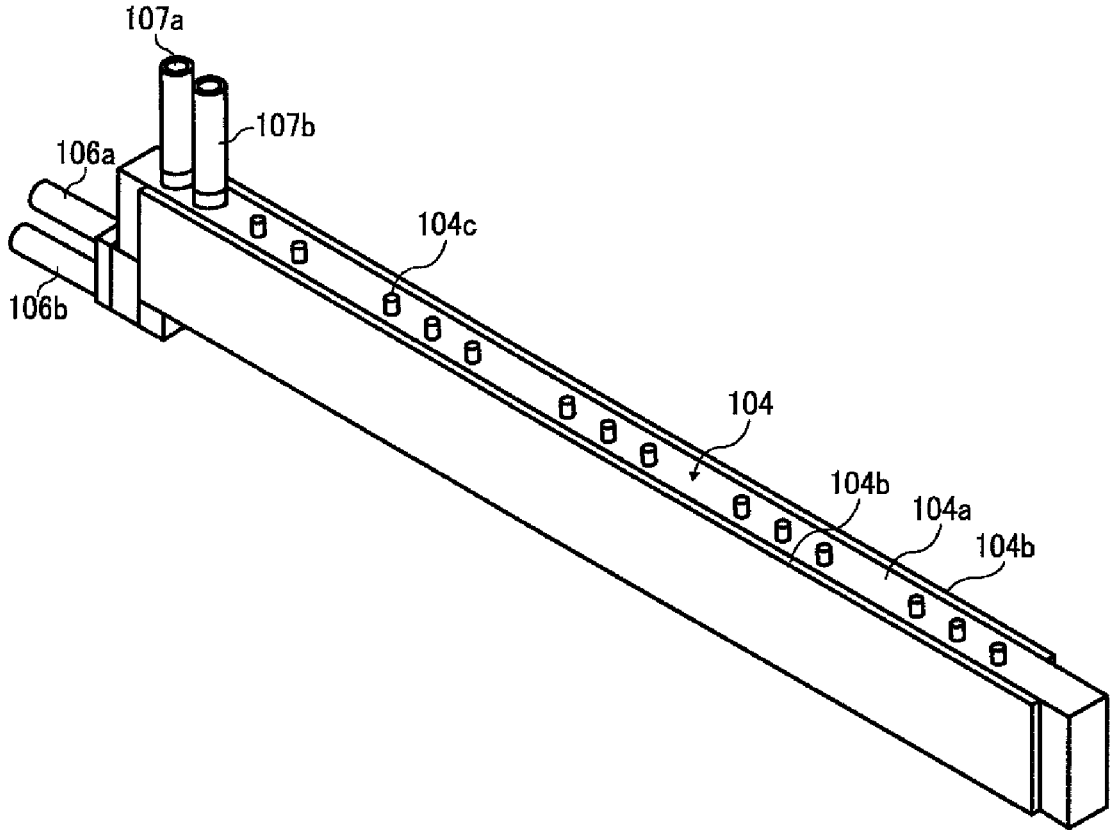
FIG. 4 is an explanatory perspective view of a branch member of the head module.
Figure 5:
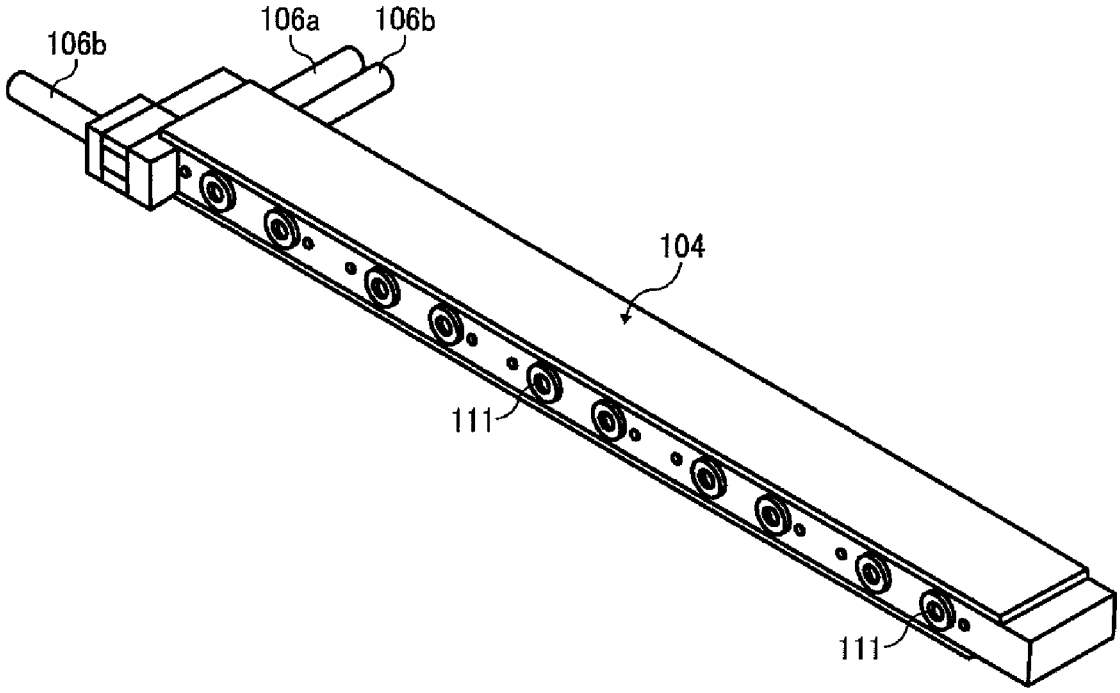
FIG. 5 is an explanatory perspective view of the branch member viewed from a bottom side.
Figure 6:
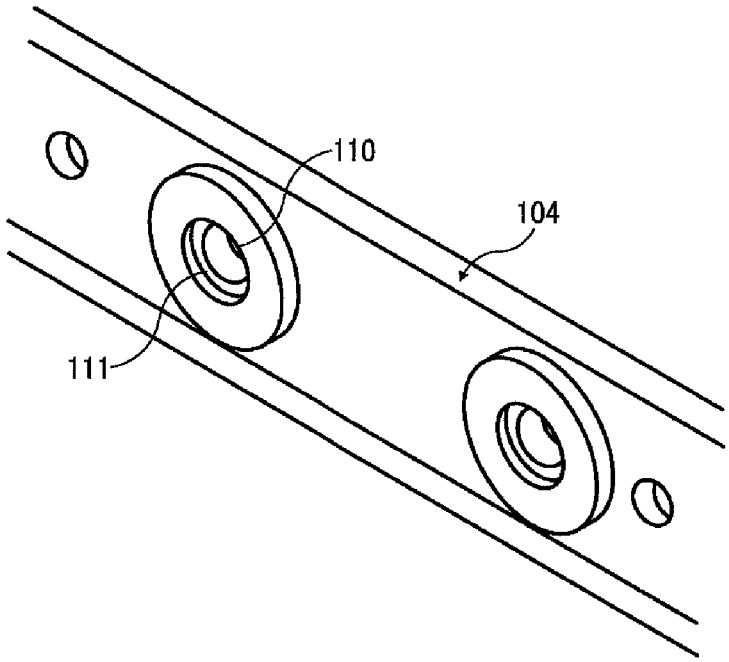
FIG. 6 is an explanatory perspective magnified view of a supply port of the branch member.
Figure 7:
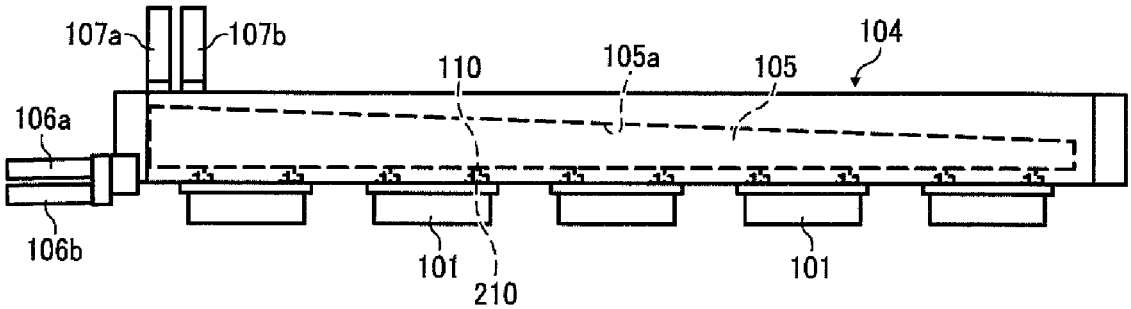
FIG. 7 is an explanatory front view of the head module.
Figure 8:
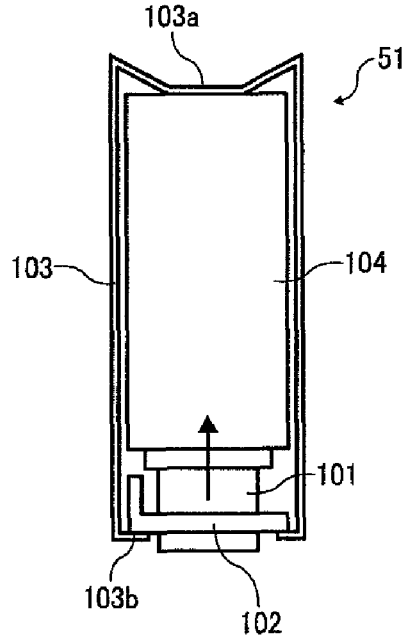
FIG. 8 is an explanatory schematic side view of the head module.
Figure 9:
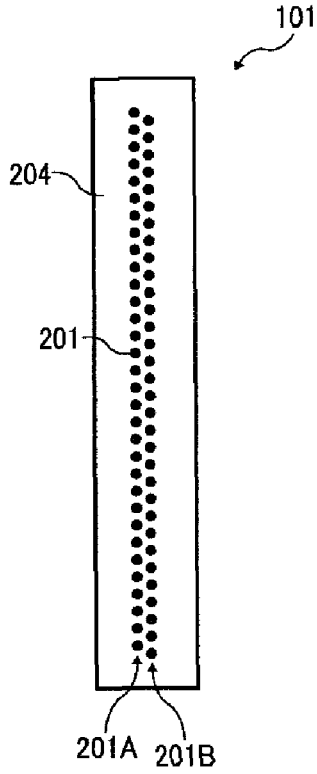
FIG. 9 is an explanatory bottom view of the head module.

FIG. 3 is an explanatory perspective view of the head modules 51*a*, 51*b*, 51*c*, and 51*d*, and FIG. 4 is an explanatory perspective view of a branch member of the head modules 51*a*, 51*b*, 51*c*, and 51*d*. FIG. 5 is an explanatory perspective view of the branch member viewed from a bottom side (connection surface of the heads). FIG. 6 is an explanatory perspective magnified view of a supply port of the branch member. FIG. 7 is an explanatory front view of the head modules 51*a*, 51*b*, 51*c*, and 51*d*, omitting a plate spring member and a base member. FIG. 8 is an explanatory schematic side view of the head modules 51*a*, 51*b*, 51*c*, and 51*d*. FIG. 9 is an explanatory bottom view of one head of the head modules 51*a*, 51*b*, 51*c*, and 51*d*.

In each of the head modules 51*a*, 51*b*, 51*c*, and 51*d*, as illustrated in FIG. 7, the plurality (five in the present embodiment) of heads 101 for discharging the liquid droplets are arranged in an array on a base member 102 in what is hereinafter also referred to as a head arrangement direction. (The base member 102 is shown in FIGS. 3 and 8.) On each of the plurality of heads 101, a branch member 104 (i.e., a common channel forming member) is provided to extend in the head arrangement direction to form a common channel 105 which distributes and supplies ink to the plurality of heads 101. The heads 101 are pressed to the base member 102 by the plate spring 103 provided between the branch member 104 and the base member 102 to form an integrated unit with the base member 102.

As illustrated in, for example, FIG. 9, each of the heads 101 includes a nozzle surface 204 including two slightly offset parallel lines of nozzles, or nozzle arrays, 201A and 201B, each provided with a plurality of nozzles 201 for discharging the liquid droplets. It is to be noted that the configuration of the head 101 is not limited to that described above, and thus, for example, the head 101 may include three or more nozzle arrays.

As illustrated in FIG. 7, the branch member 104 includes the common channel 105 inside of the branch member 104. To supply ink of different colors to the nozzle arrays 201A and 201B of each of the heads 101, the interior of the common channel 105 is divided into two sub-channels by a not-illustrated separation wall extending in the longitudinal direction of the branch member 104. To supply ink of different colors to the two sub-channels of the common channel 105, the branch member 104 is provided with ink supply ports 106*a* and 106*b* at an end portion thereof in the head arrangement direction to receive the ink supplied from the corresponding one of the ink tanks 81. Further, the common channel 105 is formed to have an upper surface 105*a* being slanted. Air release members (air communicating path) 107*a* and 107*b* are provided at the highest portion of the upper surface 105*a* of the common channel 105.

Further, as illustrated in FIG. 3, the branch member 104 includes a main branch portion 104*a* and a sidewall portion 104*b*. The main branch portion 104*a* includes a depression that forms the common channel 105, and the sidewall portions 104*b* close an opening of the main branch portion 104*a*.

As illustrated in FIG. 8, the plate spring member 103 includes a bridge portion 103*a* and a latching portion 103*b*. The bridge portion 103*a* touches the outer upper surface of the branch member 104, and the latching portion 103*b* latches the base member 102. The plate spring member 103 holds the head 101 by pressing the head 101 to the branch member 104 (to a direction shown by arrow in FIG. 8) through the base member 102 using resilient restoration force. The plate spring member 103 is engaged with an engagement pin 104*c* provided on the upper surface of the branch member 104 shown in FIG. 4. Further, two plate spring members 103 are provided at each one head 101.

Figure 10:
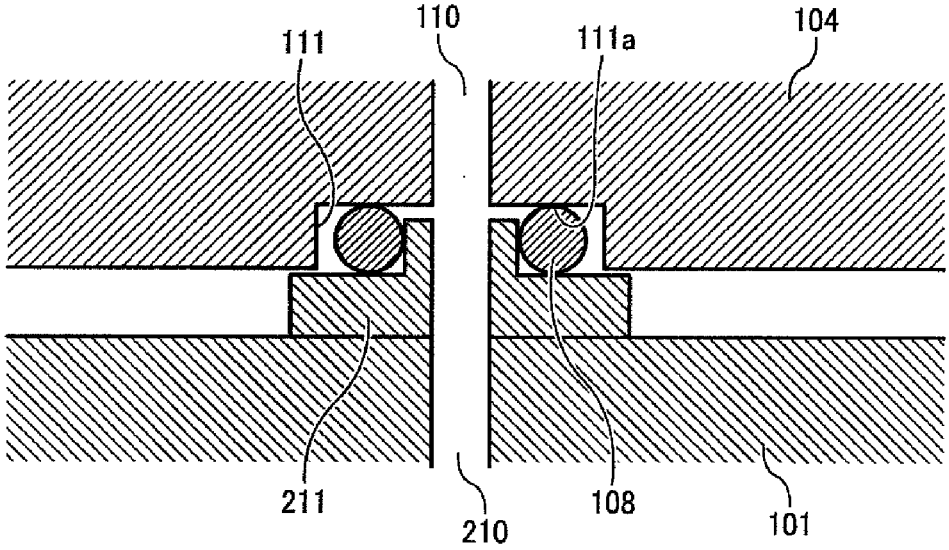
FIG. 10 is an explanatory magnified cross-sectional view of a connection portion between the branch member and a head.
Figure 11:
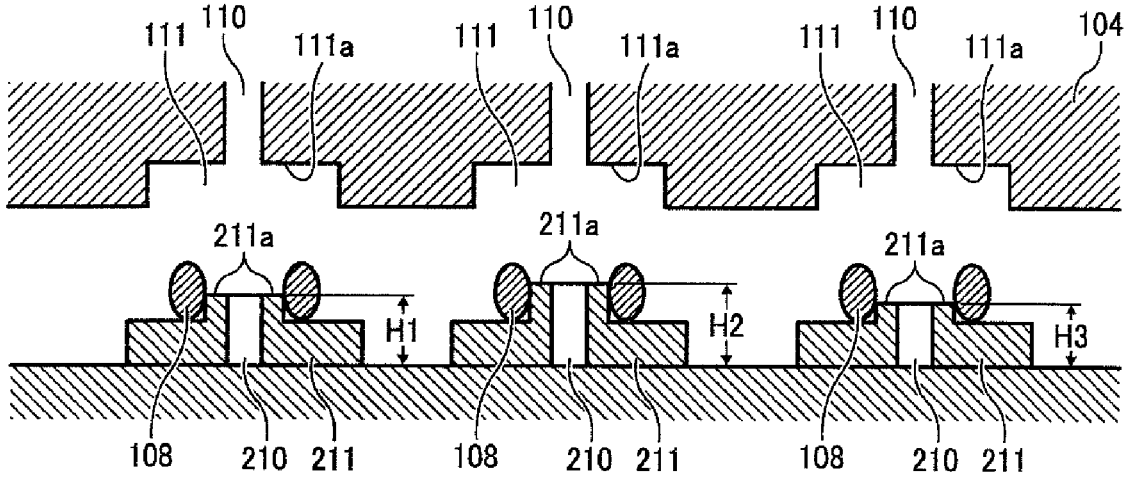
FIG. 11 is an explanatory magnified cross-sectional view of a connection portion between the branch member and the head.

With reference to FIGS. 10 and 11, a direct contacting configuration between the branch member 104 and the head 101 will be now described.

FIG. 10 is an explanatory magnified cross-sectional view of a connection portion between the branch member 104 and the head 101. FIG. 11 is an explanatory magnified cross-sectional view of a connection portion between the branch member 104 and the head 101 to explain a function.

In the head 101, a supply opening port 211 having a step-like and convex shape in cross-section and including an ink supply opening 210 is formed so that ink is supplied through the ink supply opening 210. Meanwhile, in the branch member 104, a supply opening port 111 having a concave shape in cross-section and including an ink supply opening 110 is formed so that ink is supplied from the common channel 105 to the head 101 through the ink supply opening 110.

An O-ring 108 that serves as a seal member is inserted around an outer circumference part of top portion of the supply port 211 as shown in FIGS. 10 and 11. As shown in FIG. 11, the O-ring 108 has a relatively large diameter so that a top portion of the O-ring 108 projects above a top surface 211*a* of the supply port 211 when the head 101 is not connected with the branch member 104. When the head 101 is pressed by the plate spring member 103 to connect with the branch member 104, the O-ring 108 at a side of the head 101 is pressed to a surface 111*a* of the supply port 111 of the branch member 104. Accordingly, the O-ring 108 is deformed so as to form a seal. Consequently, the ink supply opening 210 of the head 101 and the ink supply opening 110 of the branch member 104 are connected in a sealed state sealed by the O-ring 108.

The O-ring 108 is the seal member for sealing the total surface 111*a*. Accordingly, it is possible to reliably seal the connection part between the ink supply opening 210 of the head 101 and the ink supply opening 110 of the branch member 104 even if heights of the supply opening ports 211 vary among the plurality of the heads 101 (the height of the supply ports 211 are H1, H2 and H3 as shown in FIG. 11), or at one particular head 101.

As described above, the image forming apparatus according to the present invention includes the branch member 104 that serves as a liquid supply member and includes the common channel 105 for distributing and supplying ink to the plurality of the heads 101. The supply opening port 211 having the ink supply opening 210 are connected through the O-ring 108 to the supply opening port 111 having the ink supply opening 110 so that ink in the branch member 104 is supplied to the head through the ink supply openings 110 and 210. The O-ring 108 seal member seals the total surface so that the branch member 104 is connected to the head 101.

Accordingly, it is not necessary to distribute a plurality of supply tubes and connect to the respective head 101 so that ink is supplied to the respective head 101, resulting in a simple ink supply system. When the head needs to be replaced, for example, a head module that is an integration of the branch member and the head can be simply detached. Further, ink scattering and mixture of air into the ink supply path and the risk of slow air leaks are reduced because the present arrangement reduces the number of connections of the ink supply tubes, providing reliable assembly and easy maintenance.

Figure 12:
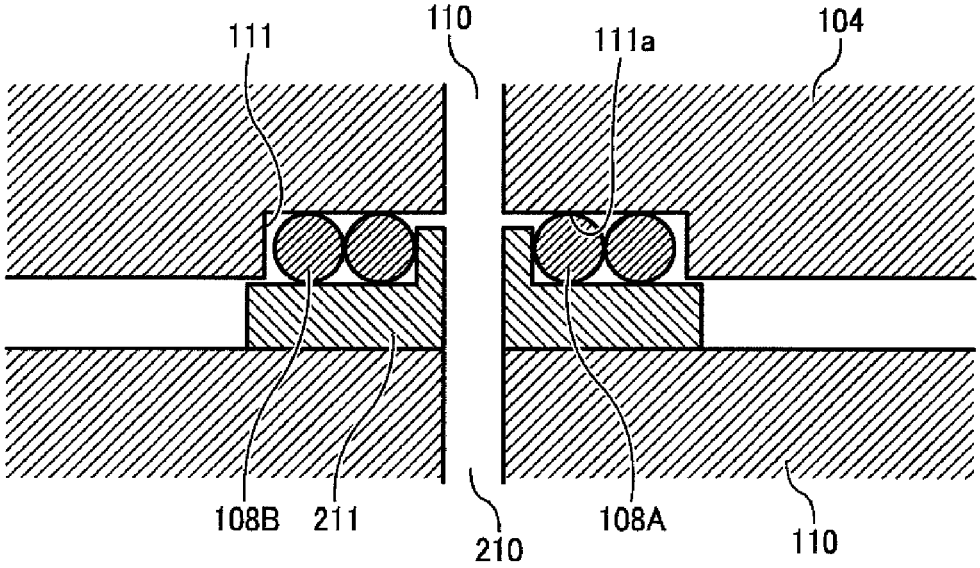
FIG. 12 is an explanatory magnified cross-sectional view of a connection portion between a branch member of a head module and a head according to another embodiment of the present invention.

With reference to FIG. 12, another embodiment according to the present invention will be described.

FIG. 12 is an explanatory magnified cross-sectional view of a connection portion between a branch member of a head module and a head according to the illustrative embodiment. In this embodiment, as a plurality of seal members for sealing one or more surfaces, two O-rings 108A and 108B of different diameters are provided around an outer circumference part of top portion of the supply opening port 211 of the head 101. Accordingly, it is possible to reliably seal the connection part between the supply opening port 111 of the branch member 104 and the supply opening port 211 of the head 101.

Figure 13:
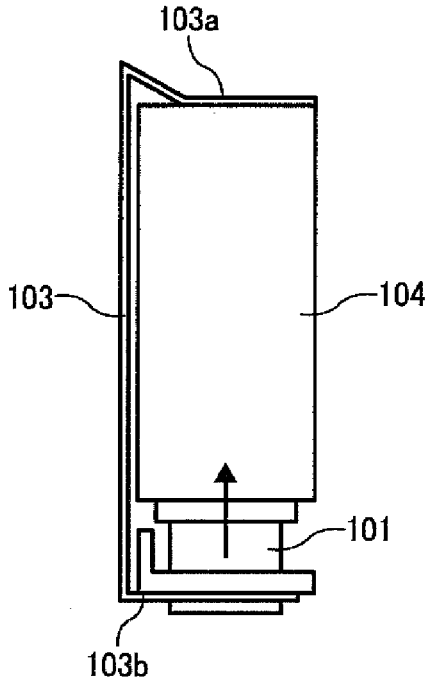
FIG. 13 is an explanatory schematic side view of a head module according to still another embodiment of the present invention.

With reference to FIG. 13, another embodiment according to the present invention will be described.

FIG. 13 is an explanatory schematic side view of a head module. The head is pressed to the branch member 104 by the plate spring 103 provided between the branch member 104 and the branch member 104 to integrate with the branch member 104. In this embodiment, the plate spring 103 holds the branch member 104 at one side. Consequently, the head module can be achieved by fewer parts.

In the present patent application, the term "image forming apparatus" refers to an apparatus which performs image formation by discharging liquid onto a medium such as paper, thread, fiber, cloth, leather, metal, plastic, glass, wood, and ceramics. Further, the term "image formation" refers not only to providing a medium with a meaningful image such as a letter and a figure, but also to providing a medium with a meaningless image such as a pattern, i.e., an operation of simply making liquid droplets land on a medium. Further, the term "ink" is not limited to what is generally called ink, but is used as a general term for all kinds of liquids usable in the image formation, such as so-called recording liquid, fixing process liquid, and liquid. For example, a DNA (deoxyribonucleic acid) sample, a resist, and a pattern material are included in the link.

Numerous additional modifications and variations are possible in light of the above teachings. It is therefore to be understood that, within the scope of the appended claims, the disclosure of this patent specification may be practiced otherwise than as specifically described herein.

This patent specification is based on Japanese Patent Application No. 2008-067055 filed on Mar. 17, 2008 in the Japanese Patent Office, the entire contents of which are incorporated by reference herein.

What is claimed is:

1. A full-width image forming apparatus comprising:

a multi-array head unit including a plurality of full-width head modules that extend across a width of a conveyed sheet, each of the plurality of full-width head modules including a plurality of short-length heads, each of the heads including nozzle rows arranged in a width direction of the conveyed sheet and which discharge liquid droplets;

a base member to hold the heads of a first head module arranged thereon, the heads of the first head module being arranged in a single row on the base member;

a liquid supply member provided on the heads of the first head module and that extends in a direction in which the heads of the first head module are arranged, and to form a common channel for distributing and supplying liquid to the heads; and a plate spring configured to cause the heads and the liquid supplying member to engage each other, wherein at least one of the heads includes a first circular supply opening port having a convex part, the first circular supply opening port including a first supply opening to receive ink from the liquid supply member and supply the ink to the head, wherein the liquid supplying member includes a plurality of second circular supply opening ports each having a concave part configured to engage the first supply opening port of the head, each second circular supply opening port having a second supply opening to supply ink from the common channel of the liquid supplying member to the head, and wherein an o-ring having a circular shape in a planar direction is provided between the liquid supply member and the head, the o-ring having a specific size configured to fit onto an outer peripheral portion of the first supply opening port, such that the o-ring protrudes above an upper surface of the convex part of the first supply opening port when the head and the liquid supplying member are not engaged, wherein when the plate spring causes the head and the liquid supplying member to engage each other, the o-ring is fit inside the concave part of the second circular supply ports, is pressed against a lower surface of the second supply opening port and is deformed to seal a connection portion between the liquid supply member and the head, such that the first supply opening and the second supply opening communicate with each other.

2. The image forming apparatus as described in claim 1, further comprising at least one more o-ring provided to connect the first and second supply openings.

3. The image forming apparatus as described in claim 2, wherein at least one o-ring has a different diameter from any other o-ring.

4. The image forming apparatus as described in claim 1, wherein the plate spring holds the head at only one side of the head.

5. An image forming apparatus comprising:

a plurality of heads, each of which discharges liquid droplets; and a liquid supply member provided on the heads to form a common channel for distributing and supplying liquid to the heads, wherein at least one of the heads includes a first circular supply opening port having a convex part, the first circular supply opening port including a first supply opening to receive ink from the liquid supply member and supply the ink to the head, wherein the liquid supplying member includes a plurality of second circular supply opening ports each having a concave part configured to engage the first supply opening port of the head, each second circular supply opening port having a second supply opening to supply ink from the common channel of the liquid supplying member to the head, wherein an o-ring having a circular shape in a planar direction is provided between the liquid supply member and the head, the o-ring having a specific size configured to fit onto an outer peripheral portion of the first supply opening port, such that the o-ring protrudes above an upper surface of the first supply opening port when the head and the liquid supplying member are not engaged, and wherein when the head and the liquid supplying member engage each other, the o-ring is pressed against a lower surface of the second supply opening port and is deformed to seal a connection portion between the head and the liquid supply member, such that the first supply opening and the second supply opening communicate with each other.

* * * * *